US008672322B2

(12) United States Patent
Choi et al.

(10) Patent No.: US 8,672,322 B2
(45) Date of Patent: Mar. 18, 2014

(54) MEDIA CURLING APPARATUS AND SYSTEMS INCLUDING TRI-ROLL MEDIA CURLER

(75) Inventors: Injae Choi, Webster, NY (US); Thomas C. Hollar, Penfield, NY (US); Peter J. Knausdorf, Henrietta, NY (US); Marina Tharayil, Rochester, NY (US); Thomas J. Wyble, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/372,071

(22) Filed: Feb. 13, 2012

(65) Prior Publication Data

US 2013/0207341 A1 Aug. 15, 2013

(51) Int. Cl.
*B65H 5/02* (2006.01)

(52) U.S. Cl.
USPC ..... 271/273; 399/406

(58) Field of Classification Search
USPC ..... 271/272, 273, 274; 399/406
See application file for complete search history.

(56) References Cited

U.S. PATENT DOCUMENTS

| | | | | |
|---|---|---|---|---|
| 2,918,897 | A * | 12/1959 | Zernov | 118/124 |
| 4,315,682 | A * | 2/1982 | Parzanici | 399/322 |
| 4,326,915 | A | 4/1982 | Mutschler, Jr. | |
| 4,475,896 | A | 10/1984 | Bains | |
| 5,123,895 | A | 6/1992 | Mandel | |
| 5,392,106 | A | 2/1995 | Bigenwald et al. | |
| 6,473,592 | B2 * | 10/2002 | Nishio | 399/406 |
| 7,532,855 | B2 * | 5/2009 | Kajita | 399/406 |
| 7,641,193 | B2 * | 1/2010 | Barinaga et al. | 271/277 |
| 7,697,884 | B2 * | 4/2010 | Tateishi | 399/406 |
| 7,865,128 | B2 * | 1/2011 | Lee | 399/406 |
| 2006/0140696 | A1 * | 6/2006 | Uehara et al. | 399/406 |
| 2008/0310900 | A1 * | 12/2008 | Lee | 399/406 |
| 2009/0129834 | A1 * | 5/2009 | Ito et al. | 399/328 |
| 2013/0195534 | A1 * | 8/2013 | Oohara et al. | 399/406 |

* cited by examiner

*Primary Examiner* — Jeremy R Severson
(74) *Attorney, Agent, or Firm* — Ronald E. Prass, Jr.; Prass LLP

(57) ABSTRACT

A tri-roll curler apparatus includes an inlet roll, and exit roll, and a penetrating roll. The three rolls have substantially equal radii. At least one of the penetrating roll, and the inlet and exit rolls may be movable. Distances between the penetrating roll and the inlet roll, and the penetrating roll and the exit roll are substantially equal.

16 Claims, 5 Drawing Sheets

MEDIA CURLING APPARATUS AND SYSTEMS INCLUDING TRI-ROLL MEDIA CURLER

FIELD OF DISCLOSURE

The disclosure relates to media curling apparatus and systems for curling and decurling media in printing systems. In particular, the disclosure relates to apparatus and systems for curling and/or decurling media using a tri-roll media curler.

BACKGROUND

Related art media curling systems include indentation, belt, and/or baffle-type curlers. An indentation curler as shown in FIG. 1A includes a soft roll 105 having an elastomeric surface that deforms under pressure applied by a penetrating roll 115, which is a hard roll that is urgable against the soft roll 105. An indentation-type curler typically requires a large force to be applied by the penetrating roll for deforming the soft roll 105, and media interposing the hard roll 115 and the soft roll 105.

A related art belt-type curler as shown in FIG. 1B includes a belt 107 entrained by one or more belt rolls 110. A penetrating roll 115 is urgable against the belt 107 for deforming media carried by the belt 107. The indentation or belt-type curler may be sufficient for light weight paper. For heavier weight paper, however, a more substantial belt deformation may be necessary to accommodate a desired deformation of media carried by the belt 107, which may be lead to premature system failure. Belt tracking issues may be problematic for heavier paper jobs.

A related art baffle-type curler as shown in FIG. 1C includes a first soft outer roll 112, a penetrating roll 115, a second soft outer roll 117, and an idler roll 120. The idler roll 120 and the first outer roll 112 define a nip entrance through which paper is fed through a narrow paper path comprising a baffle and the penetrating roll 115. The penetrating roll 115 is configured to be movable toward the baffle for bending and pushing the paper between the first outer roll 112 and the second outer roll 117, or between a roll and the baffle. The baffle-type curler may be less effective for lighter weight paper, which must be bent to have a smaller radius than is necessary for heavier weight paper. The baffle-type curler also has a configuration that curls paper while leaving larger lead edge and trail edge lengths unaffected than those of paper curled by other related art curlers.

SUMMARY

A media curler that accommodates both light weight paper and heavy weight paper is disclosed. An embodiment of a tri-roll curler apparatus may include an inlet roll; an exit roll; and a penetrating roll, the penetrating roll, the inlet roll, and the exit roll defining a paper path interposing the penetrating roll, and the inlet roll and the exit roll. In an embodiment, the inlet roll and the exit roll may be movable, wherein a distance between the inlet roll and the exit roll is fixed. In an embodiment, the penetrating roll, the inlet roll, and the exit roll may have substantially equal radii.

In an embodiment, the inlet roll and the exit roll may be configured to rotate at a same speed. The inlet roll and the exit roll may be configured for operable engagement with a drive gear. In an embodiment, the drive gear, the inlet roll, and the exit roll may be configured for simultaneously driving the inlet roll and the exit roll with the drive gear.

In an embodiment, the penetrating roll may be configured to rotate in a direction that is opposite from a direction in which the inlet roll and the exit roll are configured to rotate. In embodiment, a position of the penetrating roll may be adjustable in directions away from and toward the inlet roll and the exit roll. In an embodiment, a position of both the inlet roll and the exit roll may be adjustable in directions away from and toward the penetrating roll.

In an embodiment, the penetrating roll may be configured to contact a paper sheet on a first side, and the inlet roll and the exit roll may be configured to contact the paper sheet on a second side as the sheet passes through the paper path.

In an embodiment, a sheet curling apparatus may include an inlet/exit roll assembly; and a penetrating roll, wherein the inlet/exit roll assembly comprises an inlet roll and an exit roll. In an embodiment, a distance between the inlet/exit roll assembly and the penetrating roll may be adjustable. In an embodiment, the penetrating roll may be movable in directions toward and away from the inlet/exit roll assembly. In an embodiment, the inlet/exit roll assembly being movable in directions toward and away from the penetrating roll.

In an embodiment, the inlet/exit roll assembly further comprising the inlet roll and the exit roll may be fixedly spaced from one another. In an embodiment, a distance between the inlet roll and the penetrating roll is substantially equal to a distance between the exit roll and the penetrating roll.

In an embodiment, a printing system may have an imaging assembly for depositing a marking material image onto a substrate, and at least one sheet processing assembly, the sheet processing assembly including a tri-roll curling apparatus. The system may include a sheet feeding assembly, the sheet feeding assembly being configured to feed a sheet to the sheet processing assembly, the tri-roll curling apparatus having a penetrating roll, an inlet roll, and an exit roll, wherein the penetrating roll, the inlet roll, and the exit roll having substantially equal radii.

In an embodiment, a distance between the inlet roll and the penetrating roll may be substantially equal to a distance between the exit roll and the penetrating roll. In an embodiment, the penetrating roll may be configured to contact a first side of a sheet fed to the sheet processing assembly, and the inlet roll and the exit roll are configured to contact a second side of the sheet, whereby the penetrating roll bends a portion of the sheet that interposes a lead edge of the sheet and a trail edge of the sheet. In an embodiment, the sheet feeding assembly may include a first feed roll and a second feed roll, the first feed roll and the second feed roll being configured to simultaneously contact opposite sides of a sheet, respectively, during rotation during feeding a sheet in a processing direction.

Exemplary embodiments are described herein. It is envisioned, however, that any systems that incorporate features of apparatus and systems described herein are encompassed by the scope and spirit of the exemplary embodiments.

DETAILED DESCRIPTION

Figure 1A:
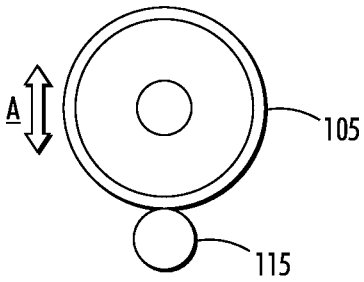
FIG. 1A RELATED ART
FIG. 1A shows a related art media curler.
Figure 1B:
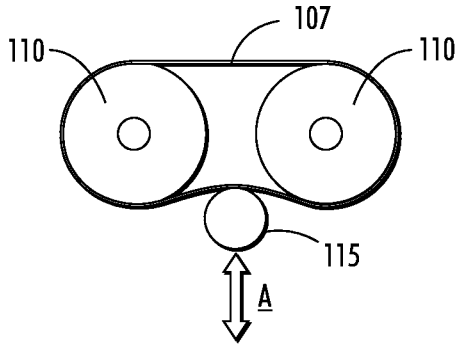
FIG. 1B RELATED ART
FIG. 1B shows a related art media curler.
Figure 1C:
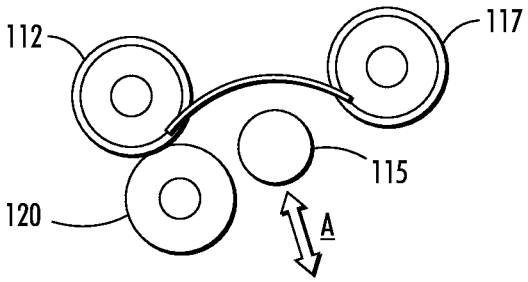
FIG. 1C RELATED ART
FIG. 1C shows a related art media curler.

Exemplary embodiments are intended to cover all alternatives, modifications, and equivalents as may be included within the spirit and scope of the apparatus and systems as described herein.

Reference is made to the drawings to accommodate understanding of paper curling and/or decurling apparatus and systems including a tri-roll media curler. In the drawings, like reference numerals are used throughout to designate similar or identical elements. The drawings depict various embodiments of illustrative tri-roll media curling apparatus and systems.

A tri-roll curling apparatus may include three rolls: an inlet roll, a penetrating roll, and an exit roll. The three rolls may be of substantially equal radii. The rolls may be formed of solid stainless steel shafts, for example. All three rolls have hard surface. The rolls may be arranged so that no baffle interposes the rolls. In an embodiment, a distance between an inlet roll and an exit roll may be fixed. A gap between the inlet roll and the exit roll may be defined to maintain a distance sufficient, e.g., to reduce a potential for stubbing failures. When a stubbing failure occurs, a lead edge of a paper sheet may be stubbed at an exit roll, or may be guided into the gap between an inlet roll and the exit roll, and a paper jam may occur.

In an embodiment, each of the inlet roll, exit roll, and penetrating roll have small radii, for example 3~10 mm. In a preferred embodiment, the rolls may have radii small enough to accommodate the curling requirement; the minimum bending radius of paper in the curler is limited by the roll radius. The inlet and exit rolls may be close enough to accommodate a configuration to prevent stubbing. A penetrating roll may be positioned at a distance from the inlet roll that is equal to a distance from the exit roll to the penetrating roll. In an embodiment, the rolls may be rotated at substantially equal speeds, and as paper is fed through gaps defined by the penetrating roll and the inlet and exit rolls, the paper may be bent and curled. The degree of bending may be adjusted by changing a position of the penetrating roll relative to the inlet and exit rolls. Tri-roll curling apparatus may be implemented in, for example, printing systems.

Figure 2:
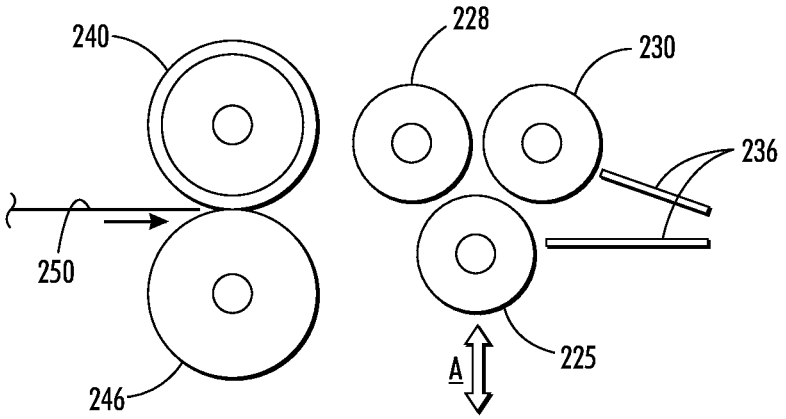
FIG. 2 shows a tri-roll media curler in accordance with an exemplary embodiment.

FIG. 2 shows a diagrammatical view a tri-roll curling apparatus in accordance with an exemplary embodiment implemented in a media processing system for processing, e.g., paper. One or more such systems may be implemented in a printing system, for example. The tri-roll curling apparatus in FIG. 2 includes a penetrating roll 225, an inlet roll 228, an exit roll 230, and baffles 236. The penetrating roll 225 may be configured to be movable in directions shown by the arrow labeled "A". Accordingly, a distance between the penetrating roll 225 and the inlet roll 228 and exit roll 230 may be adjusted. Radii of the penetrating roll 225, the inlet roll 228, and the exit roll 230 may be about equal. The radii may be small so as to accommodate a paper path effective for curling.

Further, a distance between the penetrating roll 225 and the inlet roll 228 may be about the same as the distance between the penetrating roll 225 and the exit roll 230. A distance between the penetrating roll 225, and the inlet roll 228 and the exit roll 230 may be adjusted by moving the penetrating roll 225 in directions corresponding to the directions of the double-headed arrow "A" of FIG. 2.

Baffles 236 may be used to facilitate guiding of paper through the paper path defined by the plurality of rolls, including the penetrating roll 225, the inlet roll 228, and the exit roll 230. In an embodiment of systems, a curling apparatus may be implemented with a first feed roll 240 and a second feed roll 246, which together may form a nip by which paper 250 may be fed to the inlet of the tri-roll curling apparatus comprising the inlet roll 228 and the penetrating roll 225. The paper 250 may be compressed by the three rolls, bent, and curled before passing the exit of the tri-roll curling apparatus comprising the exit roll 230 and the penetrating roll 225. The first feed roll 240 and the second feed roll 246 may comprise driver and idler rolls.

The plurality of roll surfaces of the tri-roll curling apparatus may be hard. For example, the penetrating roll 225, inlet roll 228, and exit roll 230 may be hard rolls having a surface comprising of stainless steel. The rolls may have substantially equal radii. The exit roll 230 may be arranged in a position that is fixed with respect to the position of the inlet roll 228, and the inlet roll 228 may be arranged in a position that is fixed with respect to the position of the exit roll 230. The inlet roll 228 and the exit roll 230 may be configured to be as short as possible to, e.g., avoid stubbing. For example, an inlet roll 228 and an exit roll 230 may be arranged to be spaced about 1 mm apart.

A degree of bending of media such as a paper may be adjusted by moving at least one of the penetrating roll 225, and the assembly of the inlet roll 228 and the exit roll 230 to change the distance between the inlet roll 228 and exit roll 230, and the penetrating roll 225. FIG. 2 shows, for example, that the penetrating roll 225 is movable with respect to the assembly of the inlet roll 228 and the exit roll 230.

The plurality of rolls may be rotated at a same circumferential speed to feed the paper 250 in a desired direction. For example, to feed the paper 250 from left to right, with respect to FIG. 2, the inlet roll 228 and the exit roll 230 may be rotated in a counterclockwise direction, while the penetrating roll 225 is rotated in a clockwise direction. In an embodiment, because the inlet roll 228 and the exit roll 230 may be configured to be driven in the same direction, they may share the same drive gear.

Figure 3A:
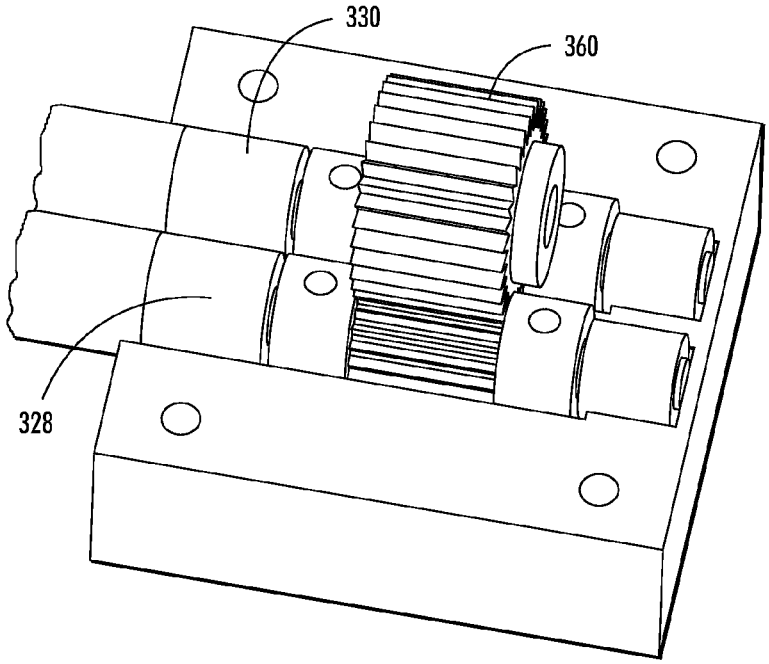
FIG. 3A shows a cross-sectional perspective view of a inlet and exit rolls of a tri-roll media curler in accordance with an exemplary embodiment.

FIG. 3A shows a cross-sectional perspective view of an inlet roll and exit roll assembly. FIG. 3A shows an inlet roll 328 and exit roll 330. The inlet roll 328 and the exit roll 330 are fixedly spaced from one another. The inlet roll 328 and the exit roll 330 are both configured to be driven by a drive gear 360.

Figure 3B:
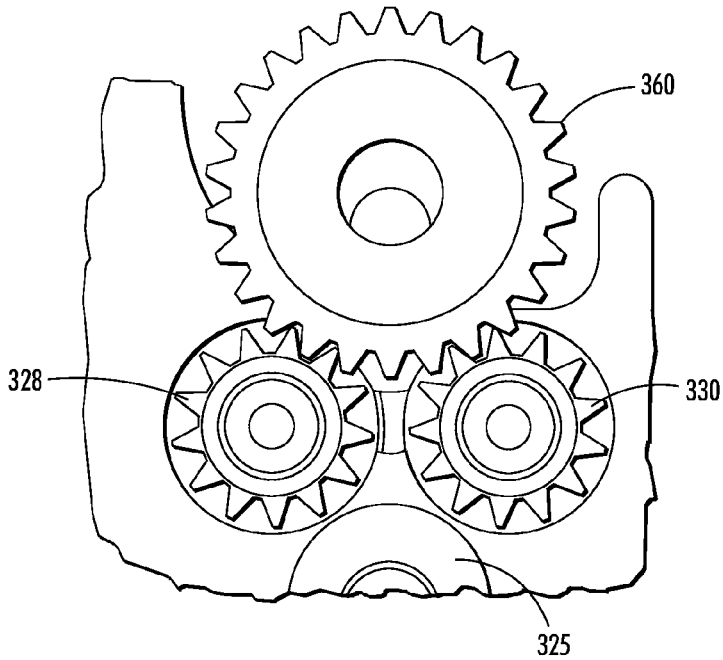
FIG. 3B shows a side diagrammatical view of the tri-roll curler of FIG. 3A.

FIG. 3B shows a cross-sectional side view of an inlet roll and exit roll assembly in a tri-roll curler apparatus. FIG. 3B shows a penetrating roll 325 positioned near the inlet roll and exit roll assembly. FIG. 3B shows an inlet roll 328 and an exit roll 330 that are fixedly spaced from one another. Both the inlet roll 328 and the exit roll 330 are set substantially equal distances apart from the penetrating roll 325. A single drive gear 360 may be configured to drive both the inlet roll 328 and the exit roll 330. The inlet roll 328 and the exit roll 330 may have substantially equal radii. The penetrating roll 325, the inlet roll 328, and the exit roll 330 may have substantially equal radii. All three rolls may have small radii so as to accommodate a paper path effective for curling.

Figure 4:
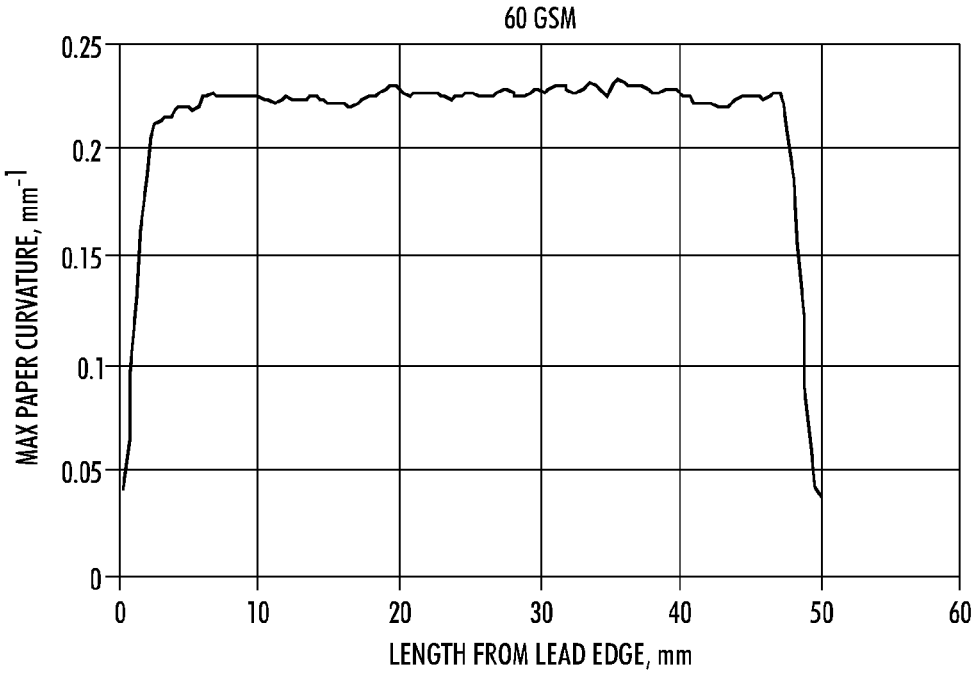
FIG. 4 shows a graph plotting a paper lead edge length against a maximum media curler-induced paper curvature.

FIG. 4 shows a graph produced from a finite element analysis plotting maximum curvature as paper passes through and is processed by a tri-roll curling apparatus in accordance with an embodiment. For the graph shown in FIG. 4, the paper was assumed to be elastic, and the bending of paper was estimated by calculating a curvature in a neutral surface of paper. The radii of rolls of the tri-roll curler used to produce the results shown in FIG. 4 was about 4 mm. The results were generated for 60 GSM bond paper. The maximum paper curvature in the body of the paper was estimated to be about 0.22 $mm^{-1}$, which is close to that of the penetrating roll, 0.25 $mm^{-1}$. Bending of paper to a degree that is close to the tri-roll curvature may be achieved with a tri-roll curler in accordance with an embodiment. By way of another example, for a tri-roll curling apparatus having rolls with a curvature of 0.33 $mm^{-1}$, a paper curvature of 0.30 $mm^{-1}$ was achieved, without any stubbing problems.

When a paper sheet is processed by a curler apparatus, a length of lead edge and trail edge paper may be unaffected by the curling process. This length is an important factor in media hold-down for direct marking printing systems because, for example, a distance between an inkjet printhead and the paper onto which marking material is to be deposited by the printhead must be controlled. In a tri-roll curler apparatus in accordance with an embodiment, as a paper sheet passes through the curler, a lead edge of the paper is not fully bent before the lead edge becomes tangent to the exit roll, while the trail edge is not fully bent, being in contact with the inlet roll or leaving the inlet roll, after tangential contact between the inlet roll and the paper is lost. The portion of the lead or trail edge that is not fully bent, may be taken as one measure of curler effectiveness.

Paper tends to be effectively curled or bent at a point along the paper path between the inlet roll and the exit roll. Accordingly, a major factor in incomplete bending is tri-roll radii. For example, FIG. 4 shows that a length of a portion of paper that exhibits incomplete bending in a tri-roll curler in accordance with an embodiment having roll radii of about 4 mm is about 3 mm long.

A lesser force than in related art of indentation-type and belt-type methods and apparatus may be used to effect desired curl using a tri-roll curler in accordance with an embodiment, because only the paper sheet needs to be bent, while a soft layer or belt also needs to be deformed in the related art system and methods. For example, an estimated force required to be applied by a penetrating roll for bending 450 GSM paper to 20 mm radius in a tri-roll curler of an embodiment having roll radii of 4 mm was about half that required of at least one related art indentation-type curlers as shown in, for example, FIG. 1A. An incompletely bent portion was about 4 mm for the both devices.

Figure 5:
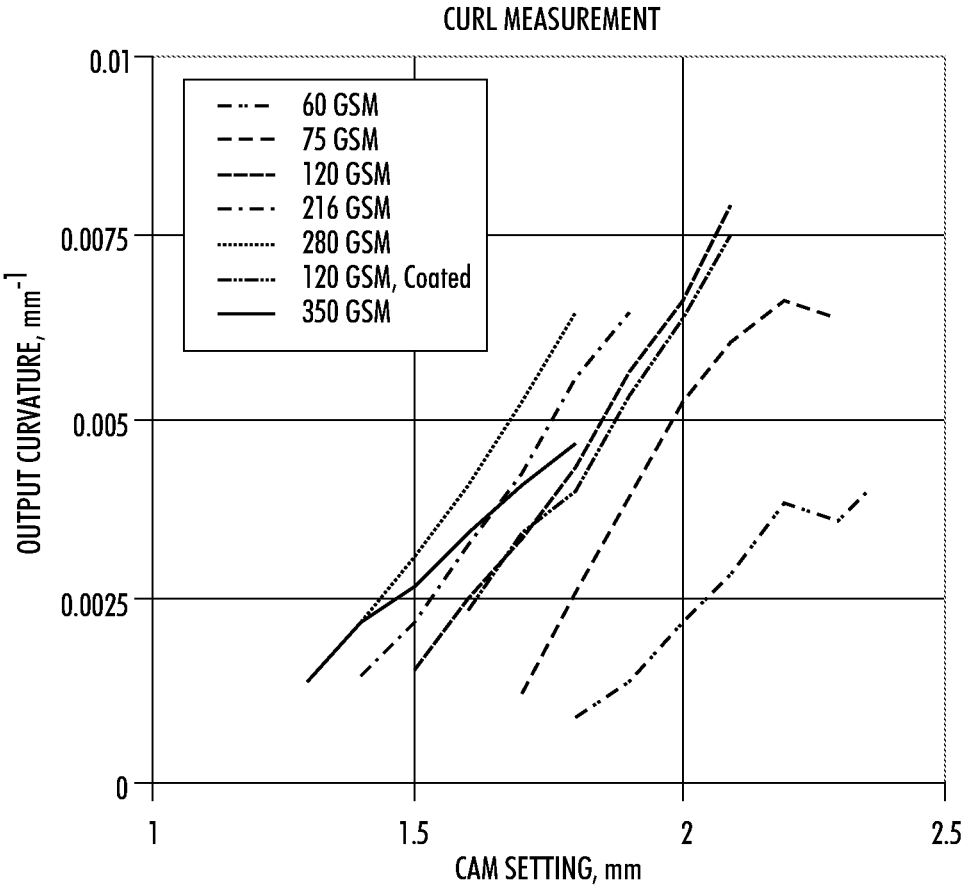
FIG. 5 shows a graph showing measured curl output for papers of various weights.

FIG. 5 shows curl measurements for paper output by a tri-roll curl apparatus in accordance with an embodiment for various kinds of flat paper. The rolls of the tri-roll curling apparatus had radii of 4 mm. The penetrating roll was set in a fixed position, and the distance between the penetrating roll, and the inlet roll and exit roll assembly decreased as the cam setting increased. As shown in FIG. 5, as the cam setting increases, the output paper curvature increases. It was found that maximum output curvatures attainable for 60 and 75 GSM paper were limited by the roll radii. A paper curvature was estimated by a finite element analysis to reach a value of about 0.25 $mm^{-1}$, which corresponds to an inverse of the roll radius.

While apparatus and systems are described in relationship to exemplary embodiments, many alternatives, modifications, and variations would be apparent to those skilled in the art. Accordingly, embodiments of apparatus and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A curler apparatus, comprising:

an inlet roll;

an exit roll; and a penetrating roll, the penetrating roll, the inlet roll, and the exit roll each having a hard surface and together defining a paper path interposing the penetrating roll, and the inlet roll and the exit roll, wherein a first distance between the inlet roll and the penetrating roll is substantially equal to a second distance between the exit roll and the penetrating roll, at least one of the penetrating roll and both the inlet roll and the exit roll being movable along a movement path in directions toward and away from the paper path, the first distance and the second distance being substantially equal to each other as the penetrating roll and/or both the inlet roll and the exit roll moves throughout the movement path, wherein a position of the penetrating roll is adjustable in directions away from and toward the inlet roll and the exit roll.

2. The apparatus of claim 1, comprising the inlet roll and the exit roll being movable, wherein a distance between the inlet roll and the exit roll is fixed.

3. The apparatus of claim 1, wherein the penetrating roll, the inlet roll and the exit roll are configured to rotate at a same speed.

4. The apparatus of claim 3, comprising:

a drive gear, the inlet roll and the exit roll being configured for operable engagement with the drive gear.

5. The apparatus of claim 4, wherein the drive gear, the inlet roll, and the exit roll are configured for simultaneously driving the inlet roll and the exit roll with the drive gear.

6. The apparatus of claim 1, wherein the penetrating roll is configured to rotate in a direction that is opposite from a direction in which the inlet roll and the exit roll are configured to rotate.

7. The apparatus of claim 1, wherein a position of both the inlet roll and the exit roll is adjustable in directions away from and toward the penetrating roll.

8. The apparatus of claim 1, the penetrating roll being configured to contact a paper sheet on a first side, and the inlet roll and the exit roll being configured to contact the paper sheet on a second side as the sheet passes through the paper path.

9. A sheet curling apparatus comprising:

an inlet/exit roll assembly; and a penetrating roll, wherein the inlet/exit roll assembly comprises an inlet roll and an exit roll, the inlet roll, the exit roll, and the penetrating roll each having a hard surface, wherein a radius of the penetrating roll is substantially equal to a radius of at least one of an inlet roll and an exit roll of the inlet/exit roll assembly, wherein a first distance between the inlet roll and the penetrating roll is substantially equal to a second distance between the exit roll and the penetrating roll, at least one of the penetrating roll and both the inlet roll and the exit roll being movable along a movement path in directions toward and away from a nip formed by the penetrating roll and both the inlet roll and the exit roll, the first distance and the second distance being substantially equal to each other as the penetrating roll and/or both the inlet roll and the exit roll moves throughout the movement path.

10. The sheet curling apparatus of claim 9, wherein a distance between the inlet/exit roll assembly and the penetrating roll is adjustable.

11. The sheet curling apparatus of claim 10, comprising the penetrating roll being movable in directions toward and away from the inlet/exit roll assembly.

12. The sheet curling apparatus of claim 10, comprising the inlet/exit roll assembly being movable in directions toward and away from the penetrating roll.

13. The sheet curling apparatus of claim 10, the inlet/exit roll assembly further comprising the inlet roll and the exit roll being fixedly spaced from one another.

14. A printing system, the system having an imaging assembly for depositing a marking material image onto a substrate, and at least one sheet processing assembly, the sheet processing assembly including a tri-roll curling apparatus, the system comprising:

a sheet feeding assembly, the sheet feeding assembly being configured to feed a sheet to the sheet processing assembly, the tri-roll curling apparatus having a penetrating roll, an inlet roll, and an exit roll, the inlet roll, the exit roll, and the penetrating roll each having a hard surface, wherein the penetrating roll, the inlet roll, and the exit roll having substantially equal radii, wherein a first distance between the inlet roll and the penetrating roll is substantially equal to a second distance between the exit roll and the penetrating roll, at least one of the penetrating roll and both the inlet roll and the exit roll being movable along a movement path in directions toward and away a nip formed by the penetrating roll and both the inlet roll and the exit roll, the first distance and the second distance being substantially equal to each other as the penetrating roll and/or both the inlet roll and the exit roll moves throughout the movement path.

15. The system of claim 14, wherein the penetrating roll is configured to contact a first side of a sheet fed to the sheet processing assembly, and the inlet roll and the exit roll are configured to contact a second side of the sheet, whereby the penetrating roll bends a portion of the sheet that interposes a lead edge of the sheet and a trail edge of the sheet.

16. The system of claim 14, wherein the sheet feeding assembly comprises a first feed roll and a second feed roll, the first feed roll and the second feed roll being configured to simultaneously contact opposite sides of a sheet, respectively, during rotation during feeding a sheet in a processing direction.

* * * * *